US008733373B2

(12) United States Patent
Vacheron et al.

(10) Patent No.: US 8,733,373 B2
(45) Date of Patent: May 27, 2014

(54) STEAM HAIRDRESSING DEVICE COMPRISING A BASE AND A PORTABLE UNIT

(75) Inventors: Xavier Vacheron, Genas (FR); Jerome Tougouchi, Genilac (FR); Martial Maisonneuve, Villefontaine (FR)

(73) Assignee: SEB S.A. (FR)

( * ) Notice: Subject to any disclaimer, the term of this patent is extended or adjusted under 35 U.S.C. 154(b) by 0 days.

(21) Appl. No.: 13/288,056

(22) Filed: Nov. 3, 2011

(65) Prior Publication Data

US 2012/0111355 A1 May 10, 2012

(30) Foreign Application Priority Data

Nov. 5, 2010 (FR) ..... 10 59120

(51) Int. Cl.
*A45D 6/06* (2006.01)

(52) U.S. Cl.
USPC ..... 132/228

(58) Field of Classification Search
USPC ..... 132/226–228, 233, 223
See application file for complete search history.

(56) References Cited

U.S. PATENT DOCUMENTS

| | | | | |
|---|---|---|---|---|
| 1,978,243 | A * | 10/1934 | Gaetano | 132/228 |
| 5,584,307 | A | 12/1996 | Bauer et al. | |
| 5,765,572 | A | 6/1998 | Paget et al. | |
| 5,781,691 | A * | 7/1998 | Kwok | 392/405 |
| 6,941,955 | B2 | 9/2005 | Yao | |
| 2007/0000512 | A1 * | 1/2007 | Park | 132/224 |
| 2009/0183382 | A1 | 7/2009 | Chuong | |
| 2009/0188516 | A1 | 7/2009 | Catini | |
| 2010/0012143 | A1 | 1/2010 | Simond et al. | |
| 2010/0170883 | A1 | 7/2010 | Legrain et al. | |

FOREIGN PATENT DOCUMENTS

| | | | |
|---|---|---|---|
| EP | 0619087 | A1 | 10/1994 |
| EP | 0659363 | A1 | 6/1995 |
| EP | 1516554 | A1 | 3/2005 |
| EP | 2145557 | A1 | 1/2010 |
| WO | 2007141276 | A2 | 12/2007 |
| WO | 2008129172 | A2 | 10/2008 |

OTHER PUBLICATIONS

English Abstract for EP 2152114 published Feb. 17, 2010, applicant SEB SA, corresponds to US 2010/0170883.

* cited by examiner

*Primary Examiner* — Rachel Steitz
(74) *Attorney, Agent, or Firm* — The Webb Law Firm

(57) ABSTRACT

Provided is a device intended for the styling of hair including: a base (1000) comprising a fluid reservoir (19), a portable unit (100) detached from the base (1000) and comprising fluid vaporization means (7), steam distribution means (7', 7") intended for hair, a cord set (21) comprising at least one line (215) intended for the passage of fluid and arranged between the fluid reservoir (19) and the vaporization means (7), the portable unit (1000) comprises a first treatment surface (4) intended to come into contact with the hair and the fluid vaporization means (7) are exclusively provided in the portable unit (100).

15 Claims, 4 Drawing Sheets

STEAM HAIRDRESSING DEVICE COMPRISING A BASE AND A PORTABLE UNIT

BACKGROUND OF THE INVENTION

1. Field of the Invention

The present invention relates to a hairdressing device using steam and intended for styling through contact with hair, specifically intended for straightening, curling, or crimping a person's hair.

2. Description of the Prior Art

Two conventional types of hairstyling devices are known that permit straightening, curling, or crimping, whose surfaces clamping the hair are flat, curved, or uneven, and are heated or heating.

Devices of the tong-type for straightening, curling, or crimping generally have two pivoting jaws, each comprising an end bearing a treatment surface, at least one of the treatment surfaces being heated, the other intended for bringing the hair in contact with the first, specifically by passing from an open jaw position permitting insertion of the hair to a closed position for putting it in contact with the heating part.

The other end of the jaws forms two half-handles serving as gripping region and allowing one to pass from an open position to a closed position. The transition is done manually by pressing the two articulated half-handles of the device towards each other to bring the treatment surfaces in contact with the hair. The straightening of a section of hair is done by moving the device along this section, from the roots toward the ends. The curling of a section of hair is done by rolling at least partially the section around the treatment surface or surfaces, and applying heat to set the curl primarily in a static manner.

To improve the styling of the hair, it is provided for in such devices to also use steam projected on to the hair.

WO2007141276 describes a curling iron with a steam generator placed away in a base. The steam is entirely and solely produced in the steam-generating base, and carried via a steam passage cord set to a portable straightener to exit through the perforated part of the hairstyling device. Similarly, EP 0659363 describes a hairstyling device comprising an external steam generator that permits circulating all types of steam necessary for styling hair. A cord set 13 connecting the hairstyling device to its base comprises at least a hose for carrying the steam, with electric cables included in the same assembly. In these two documents, the steam is formed in the base and brought via a cord set to the portable straightener. This has several disadvantages, specifically the condensation effect: the steam that is formed and routed may cool in the supply line to the portable device, and the portable device will discharge a mixture of steam and hot water, the hot water being dangerous if it is discharged on the user's scalp.

US20090183382 describes a hairstyling device of another type because it relates to a hairdryer with an external unit capable of supplying at its outlet hot air and/or steam and/or mist. A base unit comprises a water reservoir and a pump, this unit comprising a reservoir that supplies the portable hairdryer with a liquid via a cord set. The steam may be created by a heating element around the line in the hairdryer. However, the purpose of this device is to dry hair without dehydrating them by adding mist or steam to the hot air. The objective of this device is not to style hair by means of at least one treatment surface intended to be in contact with hair.

Consequently, no device for styling by contact with hair using steam has the compact, robust, automatic, straightforward design, and safe measures that can function in hot environments and can ensure a continuous, or even constant, steam output and according to the output setting.

SUMMARY OF THE INVENTION

The purpose of the present invention is to remedy at least partially the aforementioned disadvantages and to propose a device that styles by contact with the hair using steam and comprising compact, automatic means, and able to ensure a continuous output of steam.

Another purpose of the invention is a styling device with hair contacted by steam, which is able to reliably control at least the parameters of the steam function.

Another purpose of the invention is a hairstyling device with hair contacted by steam, which can ensure a continuous, even constant, output of steam corresponding to the control setting.

Another purpose of the invention is a hairstyling device with hair contacted by steam, which is solid and robust in its operation, and ensures good durability in regard to mechanical deformations, for example.

Another purpose of the invention is a hairstyling device with hair contacted by steam, which is efficient and/or quick in its operation.

Another purpose of the invention is a hairstyling device with hair contacted by steam and/or having fluid distribution, which is leak-tight in its operation.

Another purpose of the invention is a hairstyling device with hair contacted by steam, which ensures operation regardless of the device's position.

Another purpose of the invention is a hairstyling device with hair contacted by steam, which allows easy and practical use.

Another purpose of the invention is a hairstyling device with hair contacted by steam, which is simple and inexpensive in its design.

Another purpose of the invention is a hairstyling device with hair contacted by steam, which is safe and that can function in hot environments.

These objectives are achieved by a device intended for hairstyling comprising a base comprising a fluid reservoir, a portable unit detached from the base and comprising fluid vaporization means, means to distribute steam destined for the hair, a cord set comprising at least one line intended for the passage of fluid and arranged between the fluid reservoir and the vaporization means, the portable unit comprising a first treatment surface intended to come into contact with the hair and the means to vaporize the fluid being exclusively provided in the portable unit.

This device allows one to style hair by contact in a user-friendly manner, to provide a handle unit that is lightweight and easy to handle, to avoid the condensation effect described previously, to offer a lightweight base and usable in safer working conditions, to offer a less expensive device, and to offer a device with a better controlled steam output. This increases the vaporization capacity.

According to the invention, the portable unit may comprise heating means to heat the first treatment surface. Accordingly, hairstyling is carried out more efficiently by means of the contact with a hot or heated treatment surface.

According to the invention, the fluid vaporization means may comprise a vaporization chamber and means to heat the vaporization chamber. This provided chamber specifically enables a high yield of steam, in terms of homogeneity and output, and also enables one to prevent drops of fluid from not being vaporized before leaving the device. This enables the creation of a hot or heated treatment surface by heat conduction, for example, with direct or indirect contact.

According to the invention, the steam distribution means may exhibit a series of steam outlet orifices positioned laterally to the first treatment surface. This enables one to submit the hair section to two successive treatments: the steam that opens the cuticles of the hair not yet stretched or clamped and this hydrates the hair, followed by the treatment by contact (straightening, curling, or crimping, etc.) improved by the cuticles being opened and the hair being hydrated.

According to the invention, the portable unit comprises a first jaw and a second jaw arranged across from each other, the first treatment surface being borne by the first jaw, and the second treatment surface borne by the second jaw, the jaw being connected in such a manner as to pass from an open position to a closed position in such a manner that the surfaces clamp a section of hair. This enables one to perform a clamping or sandwiching of the hair to be treated to increase the treatment quality and speed. The obtained device allows one to clamp the hair and vaporize the steam towards the hair.

According to the invention, the device may comprise the heating means to heat the second treatment surface. The treatment is thus all the more enhanced.

According to the invention, the first and second hair treatment surfaces may be flat, curved, or corrugated complementary surfaces which, in the device's closed position, approximately match, thereby allowing one to straighten, curl, or respectively crimp the hair.

According to the invention, the device may comprise the means for adjusting the fluid output arranged preferentially in the base, said base which is detached from the unit, and a control unit to control at least the fluid output adjustment means. This enables one to ensure a continuous, even constant, fluid output at the inlet of the portable unit and allows one to reduce the weight of the portable unit. The output adjustment means (a pump for example) will not be subjected to a higher temperature because they are distant from the heat source, i.e., the vaporization means. The pump motor will not be affected by the temperature and its tube will not lose any of its elasticity.

According to the invention, the fluid line is made of a tubular, flexible material. This enables one to provide a flexible and pliable cord set that permits use of the portable device in all positions necessary for hairstyling.

According to the invention, the fluid line may have an interior diameter between about 0.5 mm and about 3 mm. This enables one to obtain a relatively continuous, and even relatively constant, fluid output in the order of 1 to 5 ml/min, or even between 3 and 4, but preferentially equal to 3.5 ml/min.

According to the invention, the device may comprise at least a first electric cable enclosing a first conductive wire and a second electric cable enclosing a second conductive wire, the two cables being inside a sheath and allowing at least the control unit to be supplied with power. This enables one to have all the electric cables and the fluid line in a single sheath; it also allows one to arrange all control electronics in the portable unit, to improve the handling, and to reduce the production cost of the device.

According to the invention, the cord set comprises a third electric cable 214 enclosing a third conductor 224 within sheath 216 and allowing one to supply power to at least the fluid output adjustment means. This enables one to reduce the diameter of the cord set 21, decrease the weight, increase flexibility, and ensure double electric insulation if necessary. As an alternative, the cord set may comprise a third electric cable enclosing a third conductor, the first and second cables being inside the sheath, the third cable being outside the sheath and allowing one to supply power at least to the fluid output regulation means.

According to the invention, the cord set consists at least partially of a multi-wire braid or an encapsulation. This enables one to encompass and contain in a flexible and lightweight manner at least the water line, and even the electric cables.

BRIEF DESCRIPTION OF THE DRAWINGS

The invention will be better understood by examining the embodiments provided in a non-limiting manner and illustrated here.

DETAILED DESCRIPTION OF THE INVENTION

Figure 1:
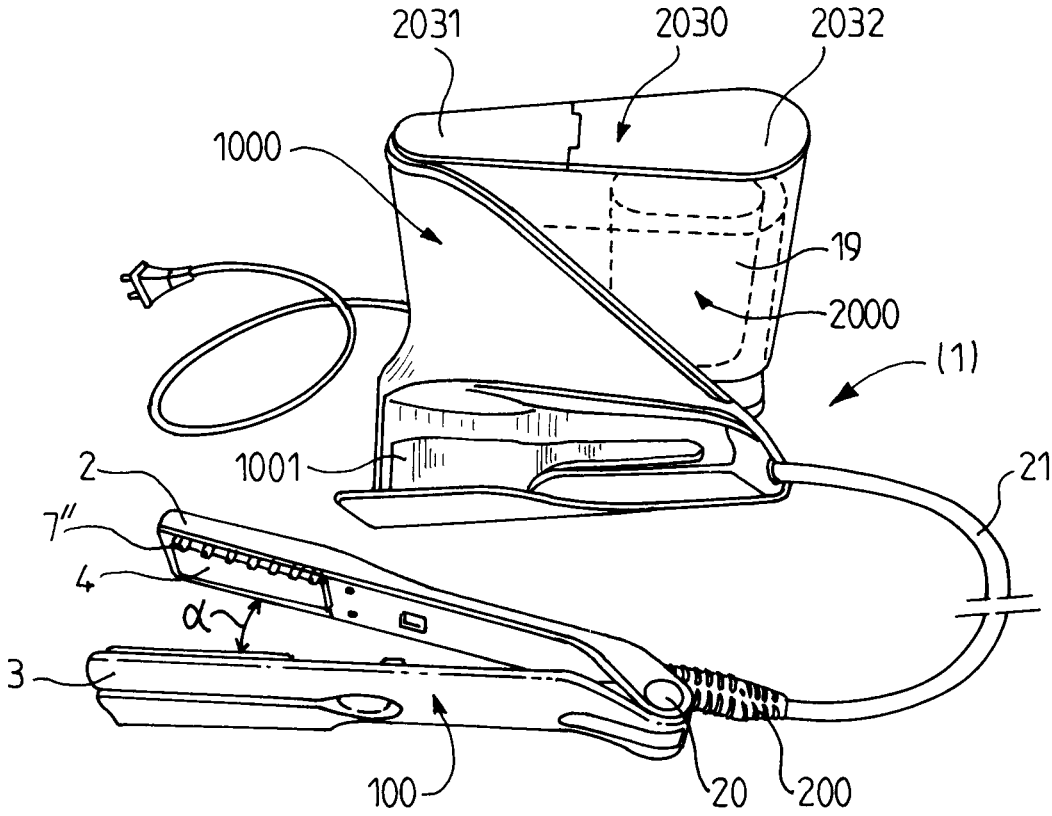
FIG. 1 depicts a view of the device according to the invention.
Figure 2:
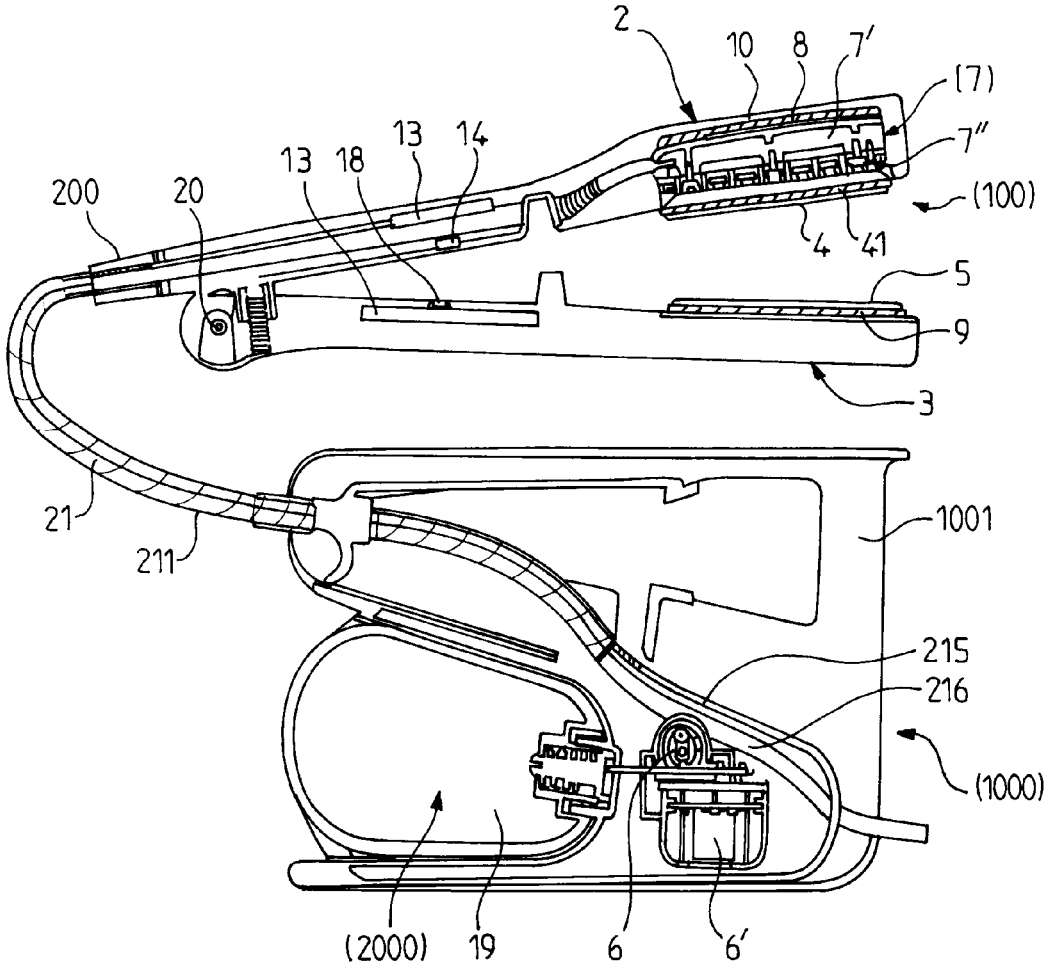
FIG. 2 depicts a longitudinal cross-section of the unit and the base according to the invention.
Figure 3:
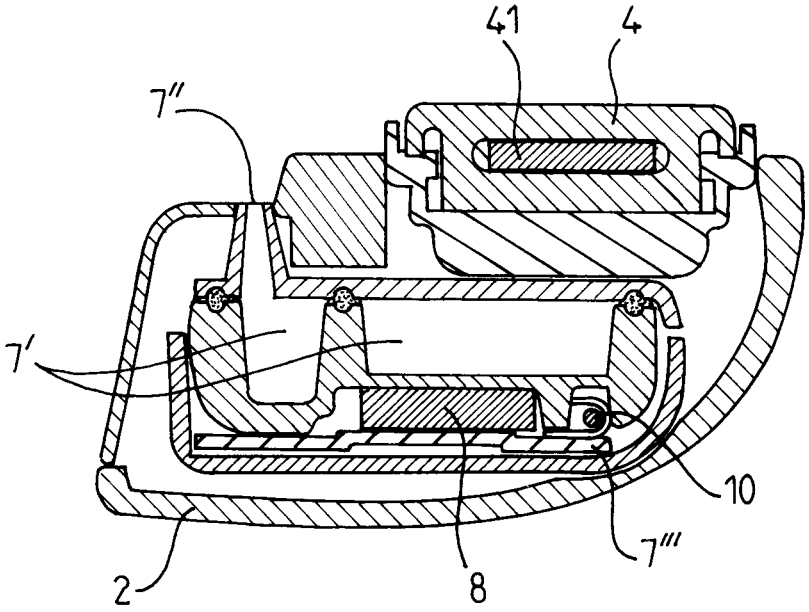
FIG. 3 depicts a transverse cross-section of one of the jaws of the unit according to the invention.

As depicted in FIGS. 1 and 2 whose numeric references correspond, the invention relates to a device 1 intended for styling hair comprising a base 1000, comprising a main fluid reservoir 19, a portable unit 100 comprising fluid vaporization means 7, steam distribution means 7', 7" intended for the hair, a cord set 21 comprising at least one line intended for the passage of fluid and arranged between main fluid reservoir 19 and vaporization means 7, portable unit 100 comprising solely or at least a first treatment surface 4 intended to come into contact with the hair and the fluid vaporization means 7 being exclusively provided in portable unit 100. The base is said to be "detached" from the portable unit, and can be placed on a work surface. The base has a pedestal 1001 to receive the portable device or handpiece 100 when it is not in use and comprises a cover 2030 having a fixed part 2031 and a movable, pivoting part 2032 to insert the fluid, the cover being completely removable to replace the demineralization means (cartridge) when necessary. One part of the base may be constructed to be transparent so that the user can be visually alerted when the ion-exchange resin changes color because it is no longer effective. It comprises demineralization means 2000 that enable one to reduce the calcium content of the fluid introduced into the base. These demineralization means 2000 are arranged between an intermediary reservoir 2100 that receives "raw" fluid and the main reservoir 19 that contains "purified" fluid intended for the hairstyling device 100. The line intended for the passage of fluid (water or water mixed with a fixative cosmetic product, etc.) is made of a material capable of transporting a fluid kept in the reservoir at a temperature between 15 and 30° C. The material may be made of silicone or inexpensive rubber that withstands temperatures up to about 30° C. without necessarily being able to tolerate hot water or steam temperatures of around 100° C. As depicted in FIG. 3, portable unit 100 comprises heating means 41 to heat the first treatment surface 4. It may pertain to a heating element 41 that may be a positive temperature coefficient (PTC) thermistor or a ceramic that is pressed against treatment surface 4 or arranged inside the element comprising treatment surface 4. Fluid vaporization means 7 comprise a vaporization chamber 7' and heating means 8 of vaporization chamber 7'. The chamber or chambers are constructed of aluminum, may comprise vapor distribution orifices 7", and be pressed in direct or indirect contact against heating element 8. Proper crushing of heating element 8, and thus its optimal functioning, takes place by a leaf spring 7''' for example. Temperature sensor 10 may be preferentially arranged above water inlet 21'. Heating element 8 of the vaporization chamber may be at least a heating element that may be a PTC thermistor or a ceramic pressed against one of the walls or arranged inside the element forming the treatment surface, they being identical or separate from the heating means of the treatment surface.

The vapor distribution means (7', 7") have a series of vapor outlet orifices 7" arranged laterally on first treatment surface 4, preferably slightly back from treatment surface 4. As an alternative or in addition, the vapor distribution means (7', 7") have a series of orifices arranged on the treatment surface. The vapor output rate is between about 3 and 4 g/min, or rather about equal to 3.5 g/min. Portable unit 100 comprises a first jaw 2 and a second jaw 3 arranged facing each other, the first treatment surface 4 being borne by the first jaw 2, a second treatment surface 5 being borne by the second jaw 3, the jaws being connected in such a manner as to pass from an open position to a closed position so that the surfaces (4, 5) clamp a section of hair.

The device has heating means 9 to heat the second treatment surface 5 of the same type as those for the first treatment surface 4. The first hair treatment surface 4 and the second hair treatment surface 5 are complementary surfaces depicted here as flat, which in a closed position of the device, approximately match but may also be curved or corrugated. A curling device with a curved surface as described for example in patent EP0619087 or EP2162114, cited for example purposes, is also affected by the invention. A curling device relates to a treatment and/or hairstyling device, preferably hand-operated, comprising [and] arranged based on a main body, a gripping means, a body for winding the sections of hair, preferably mounted to rotate freely on the main body around its longitudinal axis, and at least a mobile clamp to clamp the section of hair on the body. A crimping device is a device equipped with two jaws facing each other and each having a non-planar treatment surface, described for example in patent WO2008129172. The aforementioned patent documents are incorporated by reference herein in their entireties.

Provided are fluid output regulating means 6, for example actuated by a motor 6' preferably peristaltic, preferably arranged in the detached base and a control unit 13 for controlling at least the fluid output regulating means 6. The line for the fluid (water or water mixed with a fixative cosmetic product, etc.) is comprised of a pliable, tubular material, a material able to transport a fluid kept in the reservoir at a temperature between 15 and 30° C.

The material may be made of silicone or rubber or an elastomer such as EPDM (ethylene propylene diene monomer) or a thermoplastic elastomer such as TPV, which is inexpensive, able to tolerate temperatures up to about 30° C., without necessarily having the ability to tolerate heated water or steam temperatures around 100° C. The material is suitable for resisting low pressure (atmospheric pressure of about 1,000 mbar); however, it is not necessarily resistant to pressures exerted by the passage of steam up to 4 bar.

Figure 4:
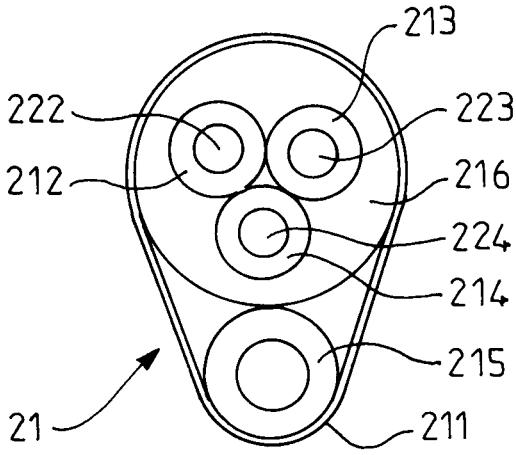
FIGS. 4', 4", and 4''' depict transversal cross-sections of the cord set according to three different variants of the invention.
Figure 4:
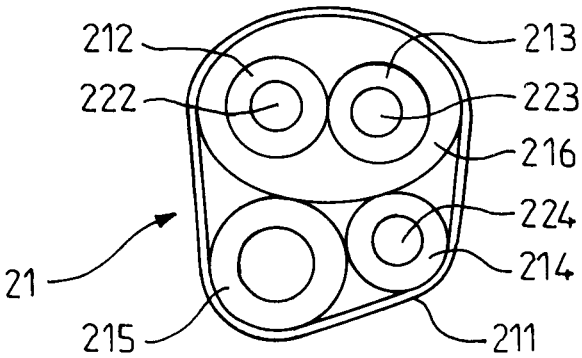
Figure 4:
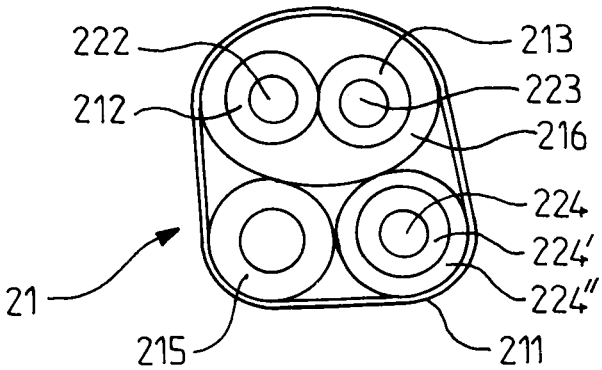

As depicted in FIGS. 4', 4", 4''', fluid line 211 has an interior diameter preferably roughly constant between about 0.5 and about 3 mm, preferably between 1 and 2.4 mm, preferably equal to 1.2 mm. This allows for a small water output without a pressure drop. The length of the cord set lies within a range of 1 m to 5 m, preferably equal to about 3 m. At least a first electric cable 212 encloses a first wire 222 and a second electric cable 212 encloses a second wire 223, the two cables being inside cord set 21 and supplying power to at least control unit 13, and also the heating elements of the vaporization chamber and the treatment surfaces: these two conductors allow one to run a voltage of 230V through them because they are doubly insulated by their respective cable 213 and 223 and by sheath 216. The first conductor 212 is the phase conductor and the second conductor 213 is the neutral conductor.

In FIG. 4', cord set 21 comprises a third electric cable 214 enclosing a third conductor 224 used as a neutral conductor. This third cable 214 and the two cables 212 and 213 are used to supply power to the low-voltage pump (8V), thereby allowing one to have more space for a conductor since the conductor used as a neutral conductor is used for the 220V voltage and for the low voltage at the same time.

As an alternative to FIG. 4', and as depicted in FIG. 4", cord set 21 comprises a third electric cable 214 enclosing a third conductor 224, the first and second cables being inside sheath 216, the third cable being outside of sheath 216. This third cable 214 used as a neutral conductor and the two cables 212 and 213 are used to supply power to the low-voltage pump (8V), allowing one to thereby have more space for a conductor since the conductor used as a neutral conductor is used for the 220 voltage and for the low voltage at the same time. The third cable is not inside the sheath because double insulation is not necessary for the 8V.

As an alternative to FIG. 4", and as depicted in FIG. 4''', the third conductor 224 may be arranged in a double insulation 224' and 224" if it is used to supply 220V of power.

The cord set is comprised at least partially of a weaving, for example a braiding and/or encapsulation of at least the water line, and also the electric cables. All conductors are doubly insulated. Other conductors may be provided for detached lighting or any other detached application within reach of the person skilled in the art.

According to a detailed mode of the invention depicted in FIGS. 4', 4", and 4''', fluid line 215 has an internal diameter of 1.2 mm, an external diameter of 3.2 mm; the electric cables have an internal diameter of 1 mm, and an external diameter of 2.4 mm; the cables are inside a sheath 216 whose external diameter is 6.8 mm, with everything being in a braid having a thickness equal to 0.3 mm, whose largest height is 10.6 mm, and the smallest thickness being 7.4 mm, the distance between the center of the fluid line and the center of the cable assembly being 5.0 mm.

The device has detection means (14, 18) for the passing from an open position and/or transition to a closed position, and the control unit is programmed to receive from the detection means (14, 18) a signal and to control, in response to the signal, at least pump 6. The detection means (14, 18) may be preferably magnetic means of detection (14, 18) of the passing to an open position and/or of a passing to a closed position. They comprise a magnetic interruptor, preferably a spring-loaded magnetic interruptor 14 arranged in the first jaw 2, a magnet 18 arranged in the second jaw 3 in such a manner that magnet 18 acts on interruptor 14 in one of two positions.

The first jaw 2 and the second jaw 3 are connected by a hinge-type articulation 20 and the maximum opening angle ($\alpha$) of the two jaws is between 5° and 60°, or between 10° and 20°, and preferably about equal to 15°. In addition, the device still depicted here is in an "open" idle position, but it may be in a "closed" idle position, as depicted in patent EP2145557, included here for reference purposes and to describe a hairstyling device comprising two jaws each bearing on its end a treatment surface, of which at least one has a heating element, said jaws being pivotably mounted on the other end around a hinge between an open position allowing insertion of the hair between the two treatment surfaces and a closed position for it to come into contact with the two treatment surfaces, said jaws passing from the open to closed position by the articulation of the two half-grips that cause the application of pressure of the treatment surfaces. The pivot axis of the two jaws carrying the treatment surfaces may be placed at the ends of the jaws (as depicted here) or be placed approximately at the middle of the jaws to provide a device with "scissor"-type articulation.

The temperature detection means 10 measure a value representing the temperature of the vaporization means 7 and the control unit may be programmed to receive from the temperature detection means 10 a signal and to control, in response to the signal, at least the peristaltic pump 6. The temperature detection means may comprise a thermistor, preferably a negative temperature coefficient (NTC) thermistor. The thermistor enables one to ensure regulation of the heating.

Description of the Invention's Operation

While in operation, when the device is ON, the thermistor-type, positive temperature coefficient (PTC) or ceramic heating element begins to heat the surfaces intended to come into contact with the hair, and a separate heating element (or the same heating element) begins to heat the vaporization means 7; the user grasps the device and applies it to clamp the section of hair to be treated; the position passes from an open position to a closed position; detection, for example magnetic detection, of the closing is executed, the signal is transmitted to the control unit (CPU), which in response to this signal, controls pump 8 of the base unit which supplies, from the liquid reservoir 19 via the cord set 21, the vaporization means, thereby creating the steam in the unit, which will be extracted via the steam distribution means to come into contact with the treated section of hair. In tests, the observed steam outputs were between about 3 and 4 g/min, or about equal to 3.5 g/min.

Advantages of the Invention

The invention brings many benefits, some of which offer a device:

- with compact, automatic means, and able to ensure a continuous steam output;
- which operates safely and reliably, that can function in high-temperature environments;
- able to ensure a continuous, and constant, output of vapor;
- solid and robust in its operation, and ensuring good durability;
- effective and/or rapid in its operation;
- leak-tight in its operation;
- ensuring operation in any position of the device.
- allowing easy and practical use
- constructed in a simple and cost-effective manner;
- with a simplified structure,
- industrially produced at a low cost,
- solid, robust in its operation and ensuring good durability in relation to mechanical deformations, for example.
- effective and/or rapid in its operation.
- leak-tight in its operation,
- being easy and practical to use; with functioning under optimal conditions of hair section placement,
- allowing rapid hair treatment,
- having less undesired friction,
- being able to actuate the element slightly before the complete closing or opening of the device to increase the effectiveness of the treatment,
- no longer being dependent on mechanical deformations of housings to actuate a component,
- no longer requiring more parasitic effort in relation to the effort exerted by the user in the closing or opening [of the device].

Obviously, the invention is in no way limited to the embodiment described and depicted, and which was only provided for example purposes. Modifications remain possible, particularly in regard to the constitution of the various elements or by substitution of equivalent methods, without however leaving the protective scope of the invention.

The invention claimed is:

1. Device intended for the styling of hair comprising:

a base comprising a fluid reservoir, a portable unit detached and separated from the base at least when the device is on and in an operating mode, and comprising a fluid vaporization mechanism, a steam distribution mechanism intended for hair, a cord set comprising at least one line intended for the passage of fluid and arranged between the fluid reservoir and the vaporization mechanism, wherein the portable unit comprises a first treatment surface intended to come into contact with the hair and in that the fluid vaporization mechanism is exclusively provided in the portable unit, and wherein fluid from the fluid reservoir is converted to steam by the fluid vaporization mechanism in the portable unit.

2. Device according to claim 1, wherein the portable unit comprises heating mechanism to heat the first treatment surface.

3. Device according to claim 1, wherein the fluid vaporization mechanism comprise a vaporization chamber and a heating mechanism of the vaporization chamber.

4. Device according to claim 1, wherein the vapor distribution mechanism have a series of steam outlet orifices arranged laterally to the first treatment surface.

5. Device according to claim 1, wherein the portable unit comprises a first jaw and a second jaw arranged facing each other, the first treatment surface being borne by the first jaw, a second treatment surface borne by the second jaw, the jaws being connected in such a manner as to pass from an open position to a closed position so that the first and second treatment surfaces clamp a section of hair.

6. Device according to claim 5 comprising a heating mechanism to heat the second treatment surface.

7. Device according to claim 6, wherein the first surface and the second surface for treating the hair are complementary surfaces that are flat, curved, or corrugated, which in the closed position of the device, approximately match.

8. Device according to claim 5, wherein the first surface and the second surface for treating the hair are complementary surfaces that are flat, curved, or corrugated, which in the closed position of the device, approximately match.

9. Device according to claim 1 comprising fluid output regulation mechanism arranged in the detached base and a control unit to control at least the fluid output regulation mechanism.

10. Device according to claim 9, including a cord set comprising at least a first electric cable enclosing a first conductive wire and a second electric cable enclosing a second conductive wire, the first and second cables being inside a sheath and allowing power to be supplied to the control unit.

11. Device according to claim 10, wherein the cord set comprises a third electric cable enclosing a third conductor inside the sheath and allowing power to be supplied at least to the fluid output regulation mechanism.

12. Device according to claim 10, wherein the cord set comprises a third electric cable enclosing a third conductor, the first and second cables being inside the sheath, the third cable being outside the sheath and allowing power to be supplied at least to the fluid output regulation mechanism.

13. Device according to claim 10, wherein the cord set is composed at least partially of a braiding or encapsulation.

14. Device according to claim 1, wherein the fluid line is composed of a pliable, tubular material.

15. Device according to claim 1, wherein the fluid line has an interior diameter between about 0.5 and about 3 mm.

* * * * *